US011353284B2

(12) United States Patent
Hall

(10) Patent No.: US 11,353,284 B2
(45) Date of Patent: Jun. 7, 2022

(54) FIREARM MAGAZINE GRIP WITH INTEGRATED ILLUMINATION AND TARGETING DEVICE

(71) Applicant: Vance Hall, Deltona, FL (US)

(72) Inventor: Vance Hall, Deltona, FL (US)

( * ) Notice: Subject to any disclaimer, the term of this patent is extended or adjusted under 35 U.S.C. 154(b) by 0 days.

(21) Appl. No.: 17/327,311

(22) Filed: May 21, 2021

(65) Prior Publication Data

US 2021/0372733 A1 Dec. 2, 2021

Related U.S. Application Data

(60) Provisional application No. 63/030,797, filed on May 27, 2020.

(51) Int. Cl.

| | |
|---|---|
| ***F41C 23/16*** | (2006.01) |
| ***F41A 3/66*** | (2006.01) |
| ***F41G 1/35*** | (2006.01) |

(52) U.S. Cl.

CPC ..... *F41C 23/16* (2013.01); *F41A 3/66* (2013.01); *F41G 1/35* (2013.01)

(58) Field of Classification Search

CPC ..... F41C 23/16; F41G 1/35
USPC ..... 42/72, 146
See application file for complete search history.

(56) References Cited

U.S. PATENT DOCUMENTS

| | | | | |
|---|---|---|---|---|
| 7,805,876 | B1 | 10/2010 | Danielson et al. | |
| 7,823,312 | B2 * | 11/2010 | Faifer | F41A 9/61 42/49.02 |
| 9,207,041 | B1 * | 12/2015 | Bast | F41C 23/16 |
| 9,909,830 | B1 | 3/2018 | Toole et al. | |
| 2006/0162225 | A1 | 7/2006 | Danielson | |
| 2011/0047850 | A1 | 3/2011 | Rievley et al. | |
| 2012/0167431 | A1 | 7/2012 | Rogers et al. | |
| 2014/0355258 | A1 | 12/2014 | Izumi et al. | |
| 2019/0017782 | A1 | 1/2019 | Toole et al. | |
| 2019/0186867 | A1 | 6/2019 | Bruhns | |

* cited by examiner

*Primary Examiner* — Reginald S Tillman, Jr.
(74) *Attorney, Agent, or Firm* — Jason T. Daniel, Esq.; Daniel Law Offices, P.A.

(57) ABSTRACT

A firearm magazine grip with an integrated illumination device and targeting device includes an elongated handgrip body having an open back end with a generally U-shaped channel extending from the top end to the open bottom end. The channel includes a shape and size for engaging a firearm magazine well, and a firearm connector is positioned along the top end of the handgrip body. A first elongated channel is disposed along one side of the handgrip body for housing a flashlight having multiple color output and strobe operation. A second elongated channel is disposed along the other side of the handgrip body for housing a laser pointer.

11 Claims, 5 Drawing Sheets

FIREARM MAGAZINE GRIP WITH INTEGRATED ILLUMINATION AND TARGETING DEVICE

CROSS-REFERENCE TO RELATED APPLICATIONS

This application claims the benefit of U.S. Application Ser. No. 63/030,797 filed on May 27, 2020, the contents of which are incorporated herein by reference.

TECHNICAL FIELD

The present invention relates generally to firearms, and more particularly to a magazine-well mounted grip with integrated illumination and targeting devices.

BACKGROUND

The statements in this section merely provide background information related to the present disclosure and may not constitute prior art.

There are many known types of firearm grips, laser sights and flashlight systems for use with commercially available assault-style rifles such as the AR-15, for example. In most instances, these systems are provided as discrete components that can be individually positioned onto a specialized accessory rail that is located along the bottom of the firearm barrel. Although such systems work to individually achieve the stated goals, their position along the rifle presents many practical drawbacks.

For example, the combined weight of a grip and the lighting unit—along with the associated battery and housing—positioned so close to the distal end of the firearm causes a noticeable shifting of the weapon's center of gravity. Over long periods of time, this can affect the shooter's accuracy due to fatigue.

Moreover, because these items extend out from the rail and are positioned far away from the lower receiver of the firearm, they often bump into foreign objects or become snared onto clothing when the user attempts to quickly raise the rifle to the firing position. This is especially true when conducting close-quarters combat operations such as those commonly employed by police and military personnel.

Accordingly, it would be beneficial to provide a firearm magazine grip with integrated illumination and targeting device that does not suffer from the drawbacks described above.

SUMMARY OF THE INVENTION

The present invention is directed to a firearm magazine grip with an integrated illumination device and targeting device. One embodiment of the present invention can include an elongated handgrip body having a top end, an open bottom end, a front wall, an open back end, and a pair of side walls. An elongated U-shaped channel extends from the top end to the open bottom end, and is configured to receive and engage the magazine well of a firearm.

In one embodiment, a firearm connector is positioned along the top end of the handgrip body and includes functionality for engaging the pivot pin of the firearm.

In one embodiment, an elongated channel can be disposed along one side of the handgrip body for housing an illumination device. The illumination device can include a flashlight having multiple color output and strobe operation.

In one embodiment, another elongated channel can be disposed along the other side of the handgrip body and can house a targeting device. The targeting device can include a laser pointer.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
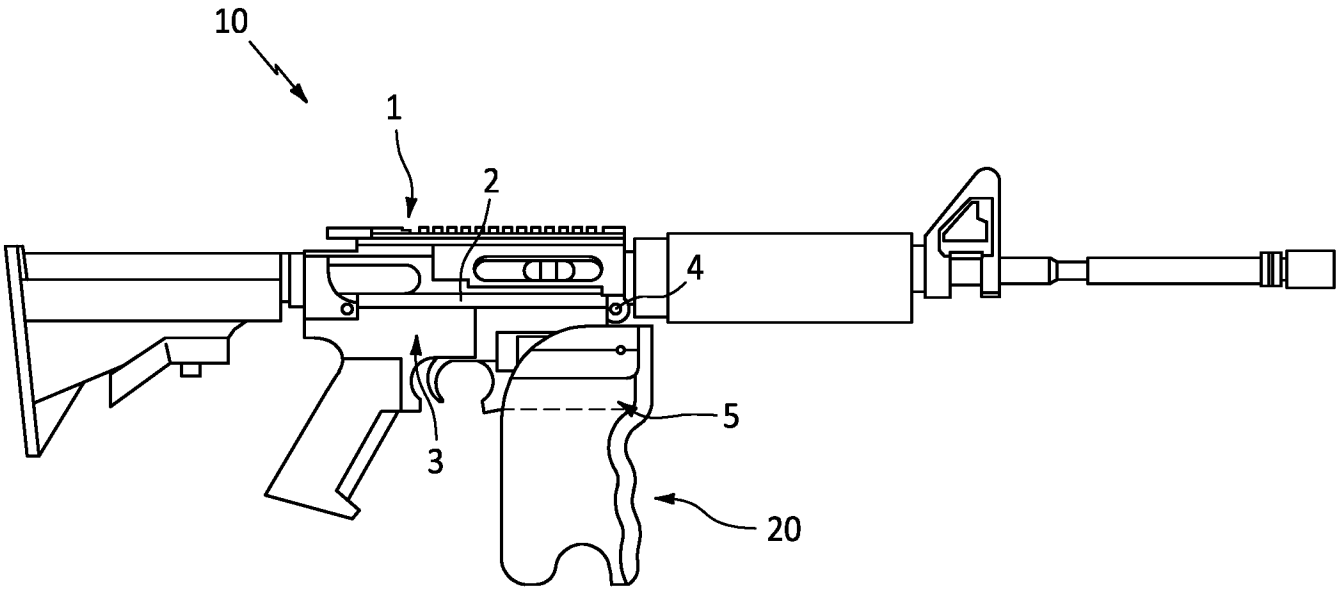
FIG. 1 is a side view of a firearm with a magazine grip with integrated illumination and targeting device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, a "unit" means a series of identified physical components which are linked together and/or function together to perform a specified function.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "connector" includes any number of different elements that work alone or together to repeatedly join two items together in a nonpermanent manner. Several nonlimiting examples include opposing strips of hook and loop material (i.e. Velcro®), attractively-oriented magnetic elements, flexible strips of interlocking projections with a slider (i.e., zipper), a thin, flexible strap with a notched surface and one end threaded through a locking mechanism (i.e., zip tie) at the other, tethers, buckles such as side release buckles, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

FIGS. 1-6 illustrate one embodiment of a firearm magazine grip with integrated illumination and targeting device 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

In one embodiment, the device 10 can include a handgrip body 20 having an illumination device 30 and a targeting device 40. The device 10 can be used in conjunction with a firearm, such as the illustrated assault rifle 1, for example, having a separate upper receiver 2 and lower receiver 3 that are secured together by a pivot pin 4 positioned along the top end of the magazine well 5. Of course, this is but one possible type of firearm with which the device 10 can be used.

Figure 2A:
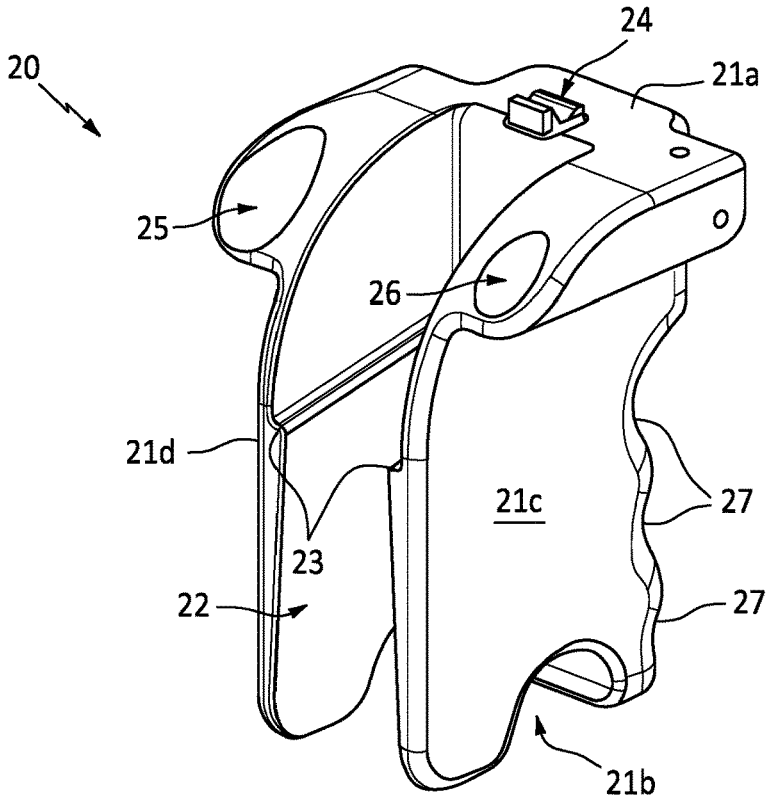
FIG. 2A is a back perspective view of the handgrip body of the firearm magazine grip with integrated illumination and targeting device, in accordance with one embodiment of the invention.
Figure 2B:
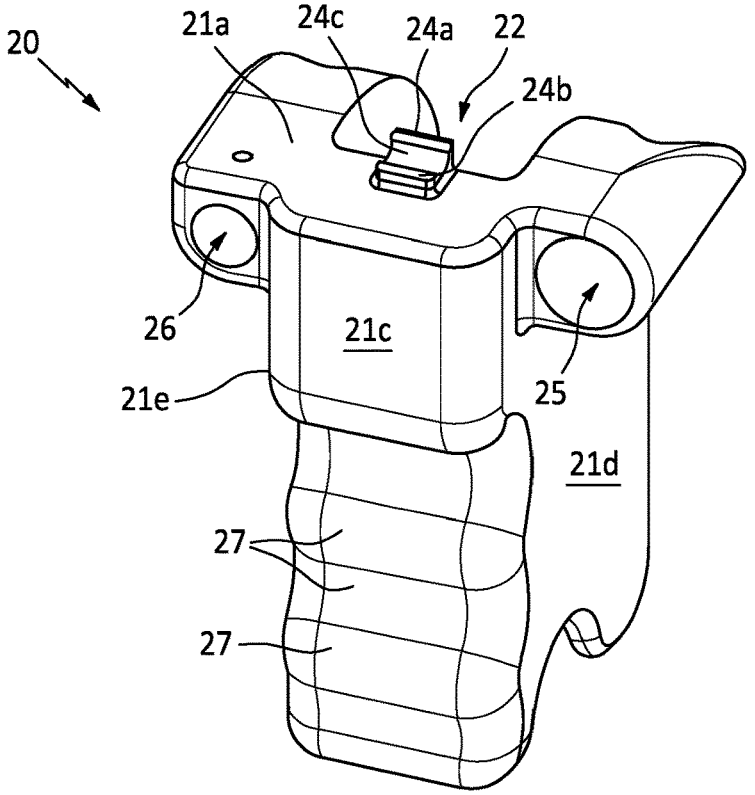
FIG. 2B is a front perspective view of the handgrip body of the firearm magazine grip with integrated illumination and targeting device, in accordance with one embodiment of the invention.

As shown best at FIGS. 2A and 2B, the handgrip body 20 can include an elongated member having a top end 21*a*, an open bottom end 21*b*, a front wall 21*c* and a pair of side walls 21*d*-21*e*. The back end of the main body can be defined by a generally U-shaped channel 22 that extends the height of the device (e.g., between the top end 21*a* and the bottom end 21*b*), and that is defined by the inside facing surfaces of the front wall 21*c* and the side walls 21*d*-21*e*.

In one embodiment, the U-shaped channel 22 can include a width (e.g., distance between side walls 21*d* and 21*e*) that is complementary to the width of the firearm magazine well 5, so as to allow the magazine well to be positioned through the open back end of the handgrip body and to be secured within the U-shaped channel.

In one embodiment, a lip 23 can be disposed perpendicularly or diagonally within the U-shaped channel 22, and can function to engage the bottom end of the magazine well 5, that is positioned within the U-shaped channel.

In one embodiment, a connector in the form of a pivot pin receptacle 24 can be disposed along the top end 21*a* of the main body. As shown best at FIG. 2B, the receptacle can include a raised back wall 24*a*, a raised front wall 24*b*, and a curved middle section 24*c*. In the preferred embodiment, the back wall 24*a* can include a height that is greater than the front wall 24*b*, and the curved middle section can include a cross sectional dimension that is complementary to the cross sectional dimension of the firearm receiver pivot pin 4.

Although described above with regard to a specific shape and size, this is for illustrative purposes only. To this end, any number of other types of connectors may be utilized along any portion of the handgrip body in order to secure the body onto the magazine well of the firearm in a removable manner.

In one embodiment, a pair of hollow channels 25 and 26 can be disposed along the sides 21*d* and 21*e* of the grip, and can function to receive and engage the below described illumination device 30 and targeting device 40, respectively. Likewise, the exterior facing portions of the handgrip body 20 can include any number of gripping elements such as various finger ridges 27 and/or texturing, for example, to aid in a user's ability to grip the device and facilitate ease of use.

As described herein, the handgrip body will preferably be constructed from a lightweight, rigid and durable material, such as plastic, for example; however, any number of other construction materials are also contemplated. Moreover, the handgrip body itself can be constructed to include any number of different shapes and sizes, so as to be compatible with virtually any type of firearm and/or to include any number of decorative designs and/or elements.

Figure 3:
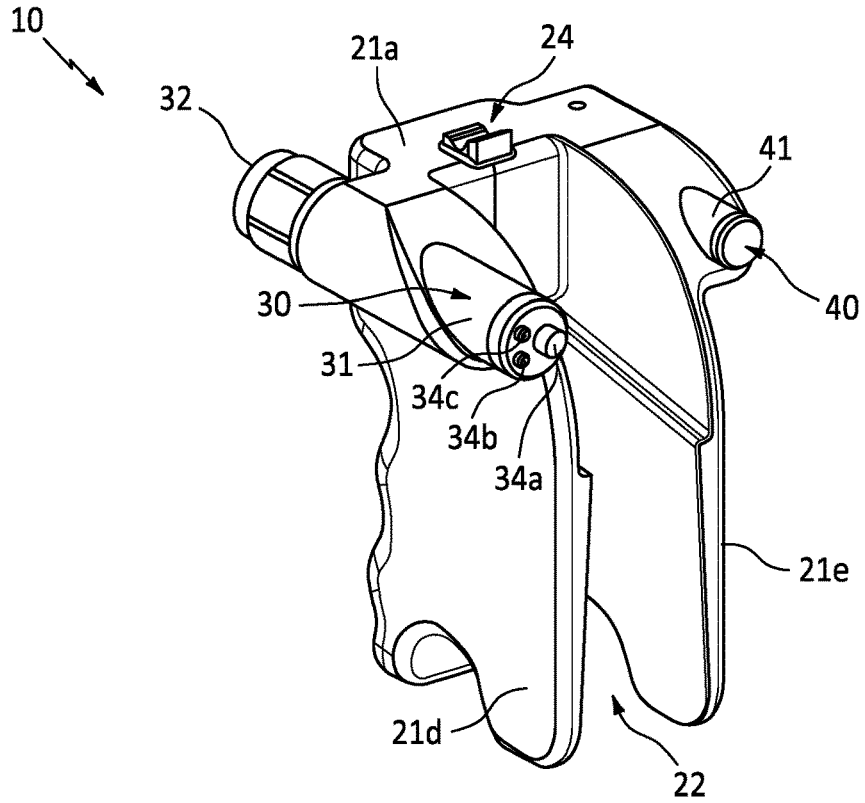
FIG. 3 is a back perspective view of the firearm magazine grip with integrated illumination and targeting device, in accordance with one embodiment of the invention.
Figure 4:
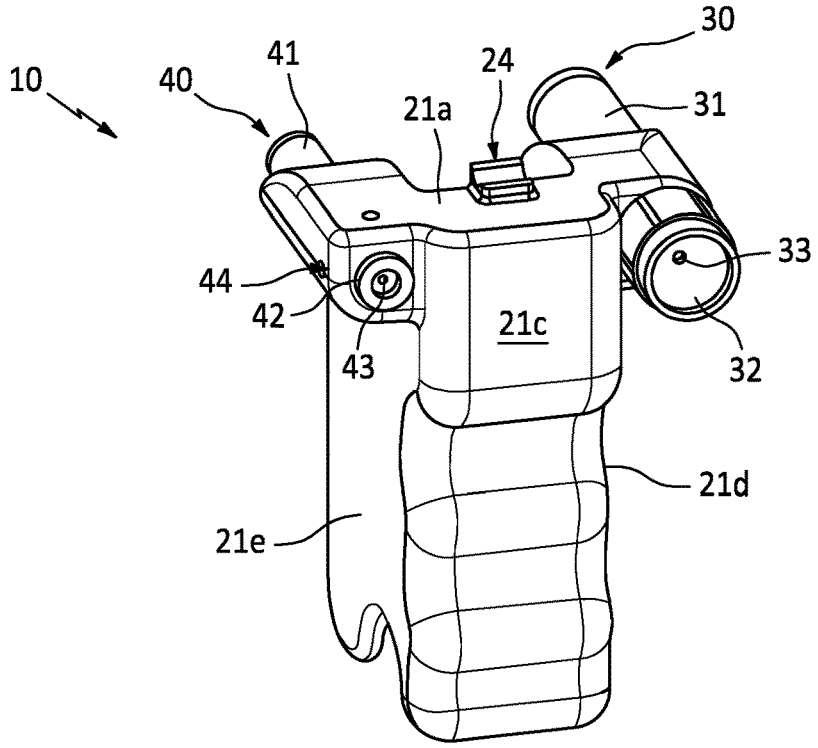
FIG. 4 is a front perspective view of the firearm magazine grip with integrated illumination and targeting device, in accordance with one embodiment of the invention.

As shown at FIGS. 3 and 4, the openings 25 and 26 can function to receive any number of different attachment devices such as the illumination device 30 and targeting device 40, respectively, for example. In one embodiment, the illumination device 30 can include, comprise or consist of a flashlight having an elongated body 31 for housing an internal battery (not shown), lens assembly 32 and light producing device such as Light Emitting Diode(s) 33 that are capable of producing light of at least 20,000 lumens. In one embodiment, the flashlight can include operational buttons, such as button 34*a* for transitioning the light between an on/off state, button 34*b* for changing the color of the light (e.g., from white to red), and/or button 34*c* for initiating a strobe effect. Of course, many other features and/or means for operating the same are also contemplated. In various embodiments, the flashlight can be custom made, or can be commercially produced in accordance with known manufacturing techniques.

In one embodiment, the targeting device 40 can include, comprise or consist of a laser pointer that can include an elongated body 41 for housing an internal battery (not shown), lens assembly 42, a laser diode 43 that emits a coherent beam of light along the visible spectrum such as 532 nm, for example. The laser pointer can be selectively transitioned between an On and Off operating state by the button 44 as shown. In various embodiments, the laser pointer can be custom made, or can be commercially produced in accordance with known manufacturing techniques.

As described herein, each of the illumination device 30 and the targeting device 40 can be provided as integral components with the handgrip body such that the housings 31 and/or 41 are formed by a portion of the handgrip body itself. Alternatively, each of the devices 30 and 40 may be manufactured as discrete components that can be removably positioned along the handgrip body via connectors and/or slid within the openings 25 and 26, respectively, so as to be removable in nature.

Figure 5:
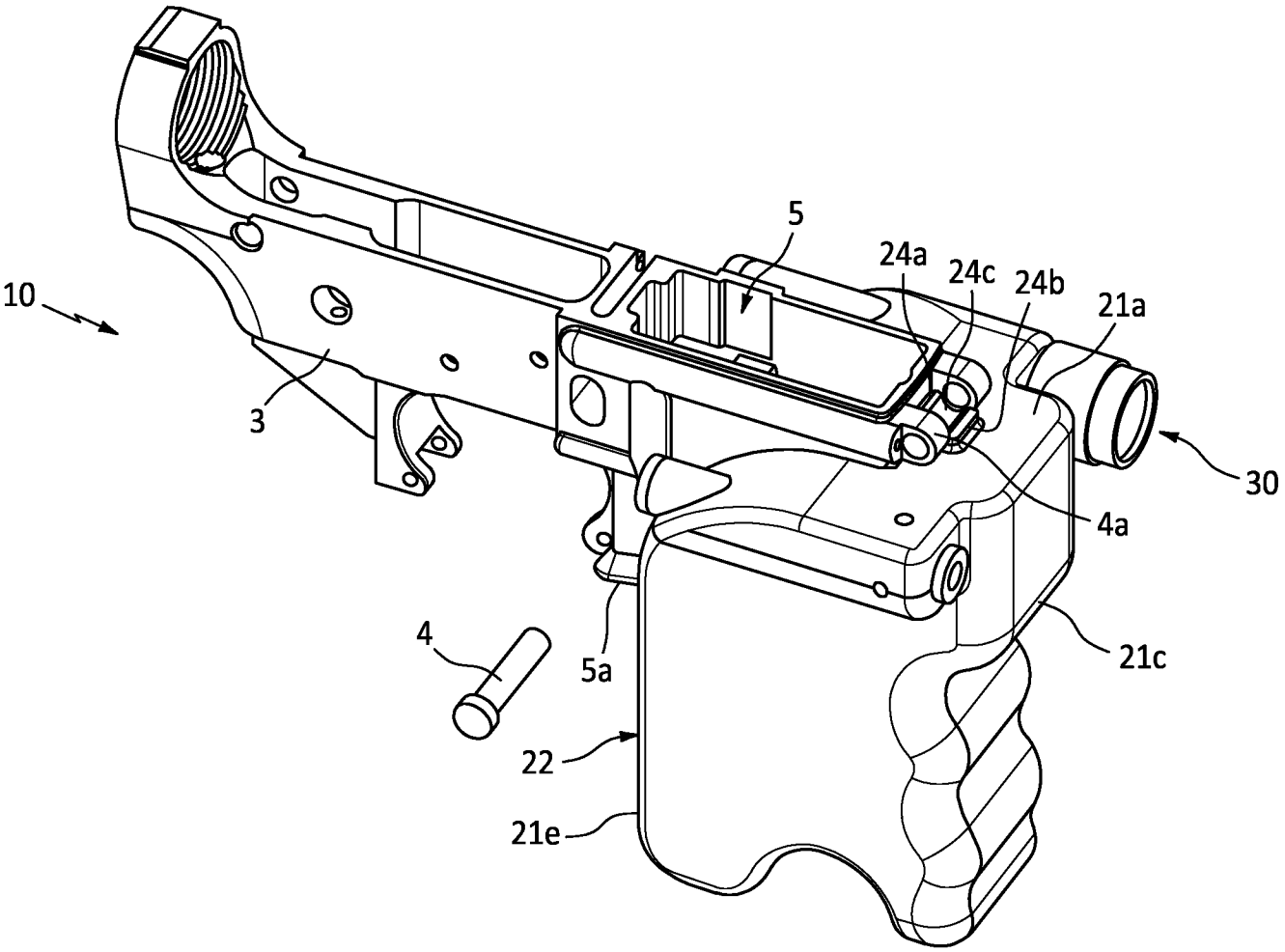
FIG. 5 is a perspective view of the firearm magazine grip with integrated illumination and targeting device in operation, in accordance with one embodiment of the invention.
Figure 6:
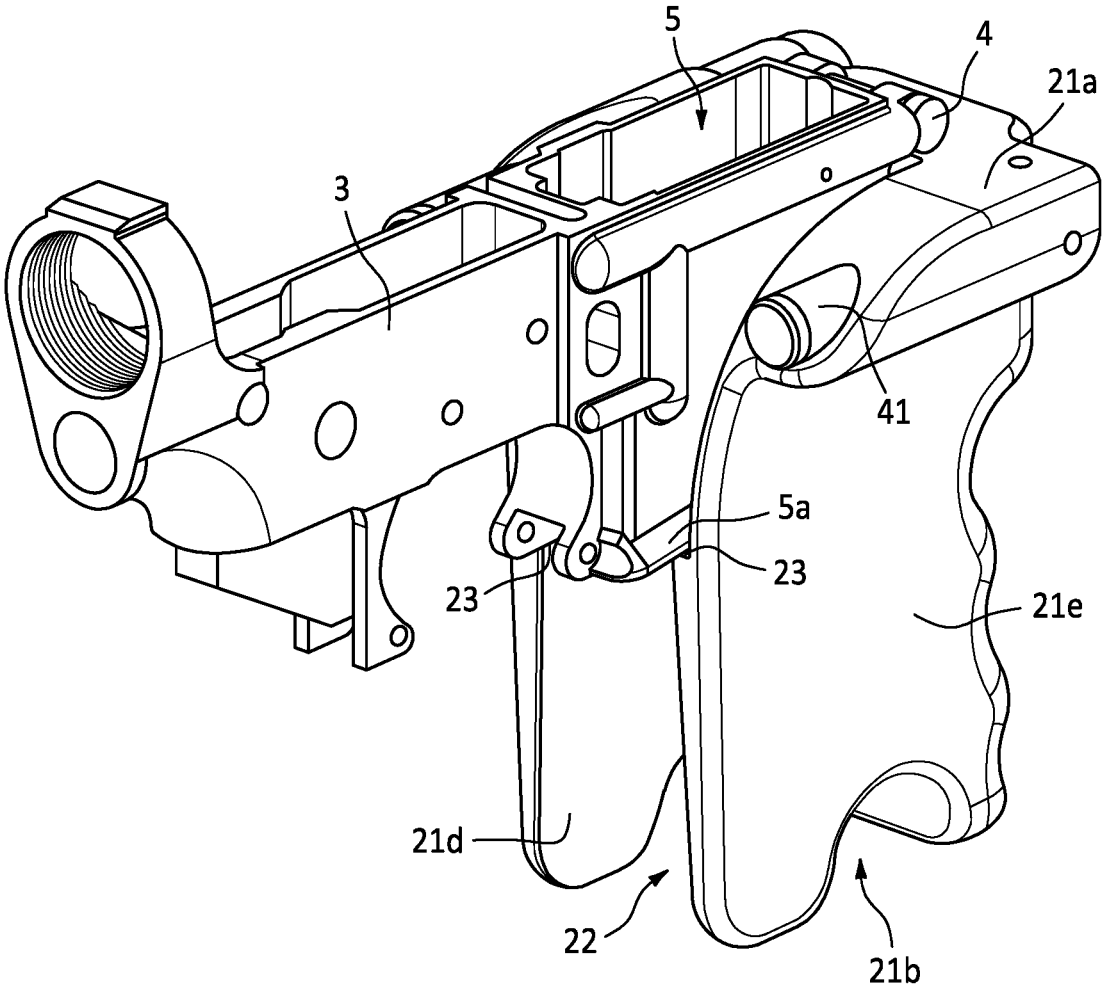
FIG. 6 is another perspective view of the firearm magazine grip with integrated illumination and targeting device in operation, in accordance with one embodiment of the invention.

FIGS. 5 and 6 illustrate one embodiment of the device 10 that is secured onto the lower receiver 3 of a firearm wherein the remaining firearm components are removed for ease of illustration. To install the device onto the receiver 3, the pin 4 is first removed, and the magazine well 5 is slid into the channel 22 until the inside facing portion of the front wall 21*c* is against the forward end of the magazine well. At this time, the bottom end of the magazine well 5*a* will be resting against the lip 23, and the curved middle portion of the pin receptacle 24 is located directly beneath the pivot pin housing 4*a*. Finally, the pivot pin 4 can be reinserted such that the front and back walls of the pin receptacle prevent movement of the grip.

When so positioned, the device 10 provides an elongated grip for the user's forward hand while aiming and firing the firearm. Moreover, because the light and laser features are incorporated into the design of the grip body, the device provides enhanced functionality to the user in a manner that does not require access to the accessory rail of the firearm, thus eliminating the drawbacks of using the same, as described above.

Although described and illustrated with respect to using the pivot pin of the firearm, this is but one possible implementation of the device. To this end, alternate embodiments are contemplated wherein the pin receptacle 24 is omitted, and the main body is secured onto the magazine well utilizing any number of connectors and/or through the use of a fitted compression design.

For example, one alternate embodiment (not illustrated) can include a resilient strap/tether that is connected to the side walls 21*d*-21*e* and that extends over a portion of the channel 22 along the open back end of the main body. In such an embodiment, the main body/tether can be stretched to allow the magazine well to be lowered into the open top end of the main body and can be held in place by shape of the main body along with the tether, in order to allow the device to function in the same manner described herein.

As described herein, one or more elements of the firearm magazine grip with integrated illumination and targeting device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A firearm magazine grip device, comprising:

an elongated handgrip body having a top end, an open bottom end, a front wall, an open back end, and a pair of side walls;

an elongated U-shaped channel that is defined by an inside facing surface of each of the front wall and the pair of side walls, said channel extending from the top end to the open bottom end;

a firearm connector that is positioned along the handgrip body;

a first elongated hollow channel that is disposed along the handgrip body; and a flashlight that is positioned within the first elongated hollow channel, wherein the handgrip body is configured to house a portion of a magazine well of a firearm within the U-shaped channel, and the connector is configured to removably secure the handgrip body onto the firearm.

2. The device of claim 1, wherein the flashlight comprises an LED flashlight.

3. The device of claim 1, wherein the flashlight produces light of at least 20,000 lumens.

4. The device of claim 1, wherein the flashlight includes functionality for selectively generating white light and red light.

5. The device of claim 1, wherein the flashlight includes functionality for producing a strobe effect.

6. The device of claim 1, further comprising:

a second elongated hollow channel that is disposed along one of the pair of side walls.

7. The device of claim 6, wherein the second elongated hollow channel is configured to receive a targeting device.

8. The device of claim 7, wherein the targeting device comprises:

a laser pointer that is positioned within the second elongated hollow channel.

9. The device of claim 8, wherein the laser pointer is configured to produce a coherent beam of light at 532 nm.

10. The device of claim 1, wherein the handgrip body is constructed from plastic.

11. The device of claim 1, further comprising:

a plurality of finger ridges that are positioned along an outside facing surface of the front wall of the handgrip body.

* * * * *